US007603800B2

(12) United States Patent
Kübert et al.

(10) Patent No.: US 7,603,800 B2
(45) Date of Patent: Oct. 20, 2009

(54) IRON WITH A VERTICAL CREASE-SMOOTHING FUNCTION

(75) Inventors: Michael Kübert, Klein-Winternheim (DE); Matthias Hahn, Frankfurt (DE); Otto Göhre, Erbach (DE)

(73) Assignee: Rowenta Werke GmbH, Offenbach (DE)

( * ) Notice: Subject to any disclaimer, the term of this patent is extended or adjusted under 35 U.S.C. 154(b) by 671 days.

(21) Appl. No.: 10/567,065

(22) PCT Filed: Jul. 12, 2004

(86) PCT No.: PCT/IB2004/002319

§ 371 (c)(1),
(2), (4) Date: Feb. 3, 2006

(87) PCT Pub. No.: WO2005/012628

PCT Pub. Date: Feb. 10, 2005

(65) Prior Publication Data

US 2007/0000159 A1 Jan. 4, 2007

(30) Foreign Application Priority Data

Aug. 5, 2003 (FR) ..... 03 09652

(51) Int. Cl.
*D06F 75/20* (2006.01)
*D06F 75/18* (2006.01)

(52) U.S. Cl. ..... 38/77.83

(58) Field of Classification Search ..... 38/74, 38/77.1, 77.7, 77.83, 93; 219/245
See application file for complete search history.

(56) References Cited

U.S. PATENT DOCUMENTS

| | | | | |
|---|---|---|---|---|
| 2,700,236 | A | 1/1955 | Marvin et al. | |
| 3,703,043 | A * | 11/1972 | Ogata et al. | 38/77.83 |
| 3,711,972 | A | 1/1973 | Risacher | |
| 4,091,551 | A | 5/1978 | Schaeffer | |
| 4,496,826 | A * | 1/1985 | Osrow | 392/335 |
| 5,345,703 | A | 9/1994 | Farrington et al. | |
| 5,404,662 | A * | 4/1995 | Patrick et al. | 38/77.82 |
| 5,444,216 | A * | 8/1995 | Bouleau et al. | 219/245 |
| 5,979,089 | A * | 11/1999 | Bouleau et al. | 38/77.83 |
| 6,802,141 | B2 * | 10/2004 | Walther | 38/77.83 |
| 6,953,912 | B2 * | 10/2005 | Alday Lesaga | 219/251 |
| 7,121,024 | B1 * | 10/2006 | Clevenberg | 38/71 |

* cited by examiner

*Primary Examiner*—Ismael Izaguirre
(74) *Attorney, Agent, or Firm*—Browdy and Neimark, PLLC

(57) ABSTRACT

An iron comprising a sole plate and a heating body (2) provided with a heating element (201), wherein the heating body (2) includes a first steam chamber (210) used for ordinary ironing, and a second steam chamber (220) used to provide extra steam when the iron is in a horizontal position, or a steam jet when the iron is in a vertical position, and liquid is supplied to said second steam chamber (220) by means of a pump manually operated by the user and combined with a steam circuit (223) ending in a set of vapour outlets in the sole plate, characterised in that when the iron is held in a vertical position, the second steam chamber (220) operates as a boiler-type steam generator, and in that when the iron is in said vertical position, the shape of the second steam chamber (220) is such that the liquid injected by the pump can be retained prior to vaporisation.

13 Claims, 5 Drawing Sheets

IRON WITH A VERTICAL CREASE-SMOOTHING FUNCTION

The present invention relates to pressing irons having two separate steam chambers. The invention more particularly relates to pressing irons having a first steam chamber used for ordinary ironing and a second steam chamber used to obtain a surplus of steam when the iron is in a horizontal position and to produce a steam jet when the iron is in a vertical position.

There are known from many documents, and in particular U.S. Pat. No. 4,091,551, pressing irons comprising two steam chambers, the first chamber being used in a conventional ironing mode and the second chamber being used in a mode of extra instantaneous steam, known as over steam. In this last mode, which is more particularly useful for smoothing difficult locations of a fabric to be ironed, water is injected, generally by means of a piston pump, in the second steam chamber where it is abruptly converted to steam under pressure before escaping via a steam circuit that leads to a steam outlet generally concentrated in a weaker zone of the sole.

Such pressing irons have a second steam chamber, of the instantaneous steaming type, which however presents the disadvantage of allowing only a steam jet of very short duration when the iron is used in the vertical position. Indeed, the small volume of water injected by the pump, in general less than 1 ml, is immediately converted to steam in contact with the overheated steam chamber, then causing a strong increase in the pressure and a steam jet exiting from the sole plate lasting approximately one-fourth of a second.

Thus, to obtain steam during a sufficiently long time to carry out a vertical smoothing, the user is obliged to actuate the piston pump regularly so as to obtain a succession of steam jets of short duration. Not only is this manipulation tiring for the user, but in addition the different actuations of the pump cannot be made too close together because the pressure in the steam chamber is very significant at the moment of conversion of the water into steam. There follows that it is tiresome and difficult to obtain, with such irons, a jet of steam being produced in a substantially continuous manner over several seconds when the iron is used in the vertical position.

The invention which follows aims at mitigating these disadvantages.

The goal of the invention is achieved by a pressing iron having a sole plate and a heating body provided with a heater, the heating body comprising a first steam chamber used for ordinary ironing and a second steam chamber used to obtain a surplus of steam when the iron is in the horizontal position or a jet of steam when the iron is in the vertical position, the second steam chamber being fed with liquid by means of a manual pump actuated by the user and being associated with a steam circuit ending in a set of steam openings in the sole plate, characterized in that the second steam chamber functions as a steam generator of the boiler type when the iron is held vertically and in what, in this vertical position of the iron, the second steam chamber presents a form adapted to retain the liquid injected by the pump before its conversion into steam.

Such a characteristic makes it possible to obtain a pressing iron producing, in the vertical position, a steam jet lasting much longer than irons of the prior art in which the second steam chamber is of the instantaneous steam generation type.

According to another characteristic of the invention, the second steam chamber presents a form such that its heat exchange surface between the injected liquid and its walls is smaller when the iron is in the vertical position than when the iron is in the horizontal position.

This characteristic makes it possible to obtain an iron in which the steam generated by the second steam chamber is produced over a longer duration when the iron is held vertically than when the iron rests horizontally.

According to another characteristic of the invention, the second steam chamber is delimited by at least one wall whose form and thickness are such that, in operation, the thermal energy stored in this wall is greater toward the front of the sole plate than towards the rear of the sole plate.

Such a characteristic makes it possible to limit the quantity of energy stored in the walls of the low part of the steam chamber when the iron is held vertically, so as to obtain a slow conversion to steam in this position. Conversely, a greater quantity of energy is stored in the walls of the steam chamber located toward the front of the iron, which makes it possible to obtain a faster conversion of the liquid injected into the second steam chamber into steam when the iron rests horizontally.

According to another characteristic of the invention, the thickness of the lower wall of the second steam chamber is greater toward the front of sole plate than toward the rear of the sole plate.

According to another characteristic of the invention, the second steam chamber has a side wall near to the heating element that is at least locally isolated from the heating body by a layer of air.

Such a characteristic makes it possible to reduce the thermal conduction between the side wall of the second steam chamber and the heating element so as to lower the temperature of this wall.

According to still another characteristic of the invention, the second steam chamber is delimited by side walls connected to lower and upper walls disposed parallel to the sole plate, the side wall nearest to the front of the iron having an opening connecting the second steam chamber to the steam circuit.

Such a characteristic makes it possible to prevent the liquid injected into the second steam chamber from flowing out of this chamber before being converted into steam.

According to still another characteristic of the invention, the opening of the side wall has a passage cross section calibrated to retard the steam flow leaving the second steam chamber.

According to still another characteristic of the invention, the opening has an added element of plastic material or rubber that determines the passage cross section.

According to still another characteristic of the invention, the added element has a cylindrical part extending toward the interior of the steam chamber.

According to other particular embodiments of the invention, the pressing iron according to the invention can comprise one or several of the combinations taken separately or according to all technically possible combinations:

- the temperature of the walls of the second steam chamber is lower than 150° C.;
- the volume of the second steam chamber corresponds to several times the volume of liquid injected by the pump with each actuation by the user;
- the second steam chamber has a lower wall, disposed parallel to the sole plate, having projecting elements increasing the heat exchange surface with the liquid injected into the chamber when the iron rests horizontally on its sole plate;
- the volume of the second steam chamber is about 5 ml and the volume of liquid injected by the pump at each actuation is about 1 ml.

One will better understand the goals, aspects and advantages of the present invention, according to the description given hereafter of a particular embodiment of the invention presented as a nonlimiting example, while referring to the annexed drawings in which.

Only the elements necessary for an understanding of the invention have been represented. To facilitate reading of the drawings the same elements have the same reference numerals from one figure to another.

Figure 1:
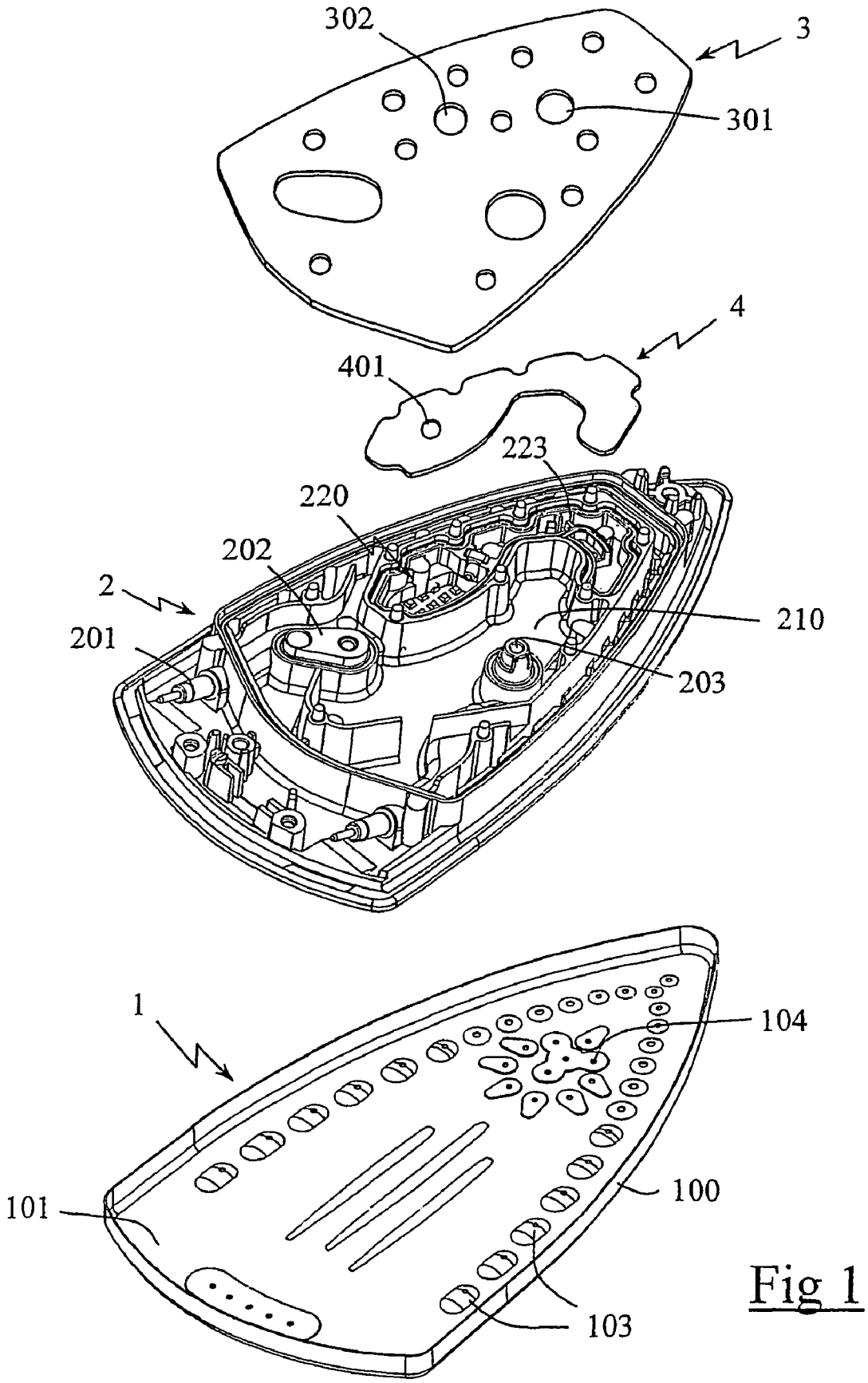
FIG. 1 is an exploded perspective view of an iron sole plate assembly according to a particular embodiment of the invention.

In a first embodiment of the invention, the steam pressing iron, having a pointed form toward the front, has a sole plate assembly visible in FIG. 1. This assembly located conventionally below the water reservoir of the pressing iron has a sole plate 1, a heating body 2, one cover plate 3 and another cover plate 4.

The sole plate is made of sheet metal stamped to have raised edges 100, the substantially flat lower face being the ironing face.

The heating body 2, comprising a resistive element 201 curved in the form of a horseshoe, is adapted in a known way to the interior face 101 of sole plate 1 to be mechanically and thermally joined together. A boss 202 is provided to receive a thermostat for regulating the temperature of sole plate 1 and another boss 203 is provided to receive the thermostat for regulation of an anti-drip valve.

Figure 2:
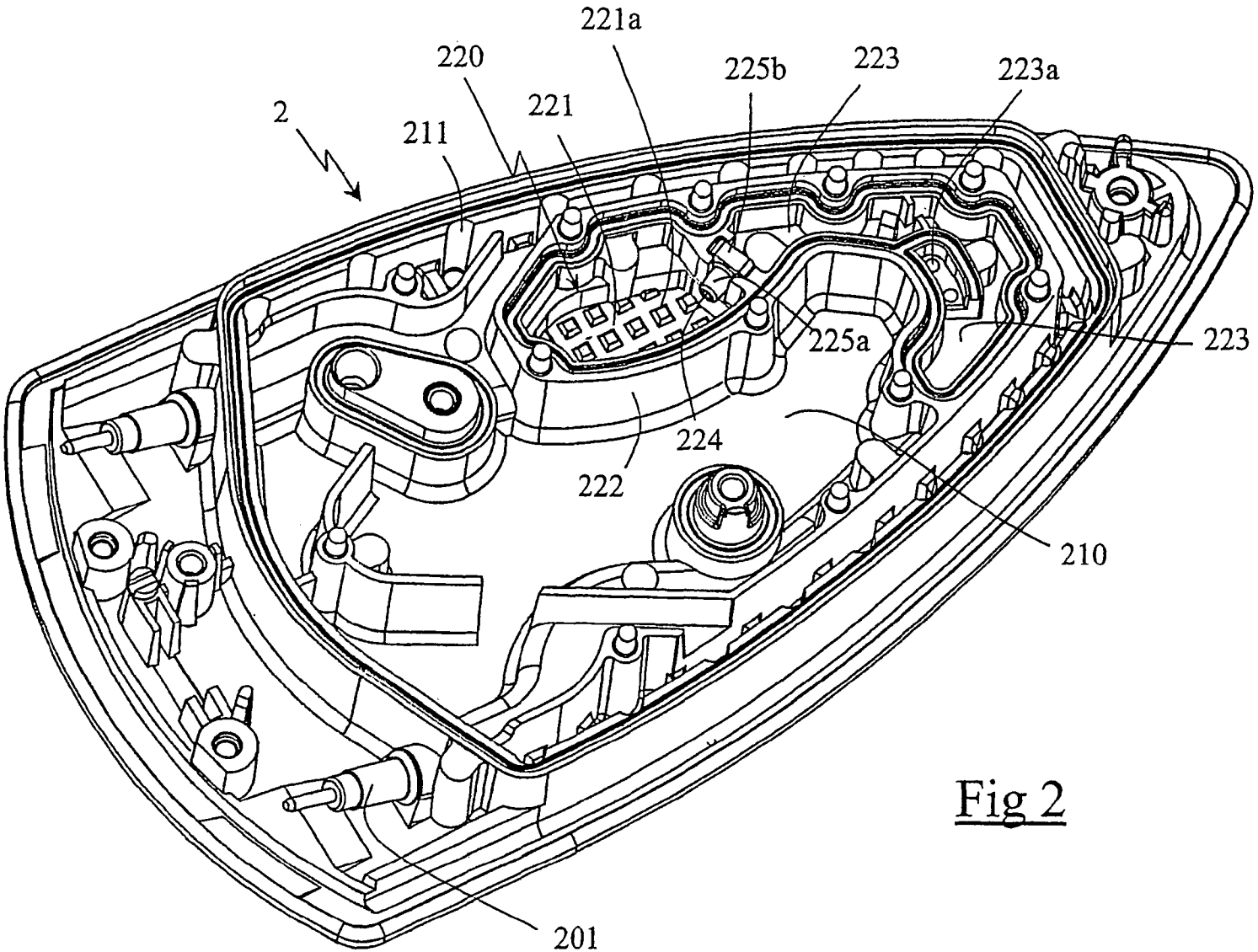
FIG. 2 is an enlarged perspective view of the heating body of the iron sole plate of FIG. 1.

In accordance with FIG. 2, heating body 2 has in its upper part a first steam chamber 210 of large dimensions and closed by the cover plate 3. Steam chamber 210 is of the instantaneous steam production type. Water from the reservoir arrives drop by drop in this chamber 210 through opening 301 of plate 3, is converted abruptly into steam, and the steam, distributed by channels 211, traverses body 2 to leave therefrom onto ironed fabric through corresponding holes 103 of sole plate 1.

Steam chamber 210 receiving water drop by drop produces steam for normal and conventional ironing and its operation is known.

More particularly according to the invention, heating body 2 also comprises, in front of its upper part, a second steam chamber 220 surrounded by the steam circuit previously described and closed by plate 4. This steam chamber 220 is delimited by plate 4, a lower wall 221 parallel to the sole plate and side walls 222. Steam chamber 220 is located substantially halfway between the front tip and the back edge of sole plate 1 and is laterally distant from one of the branches of resistive element 201 in the form of a horseshoe so that in operation the temperature of the steam chamber 220 is lower than 150° C. and preferentially of the order of 130° C.

Figure 3:
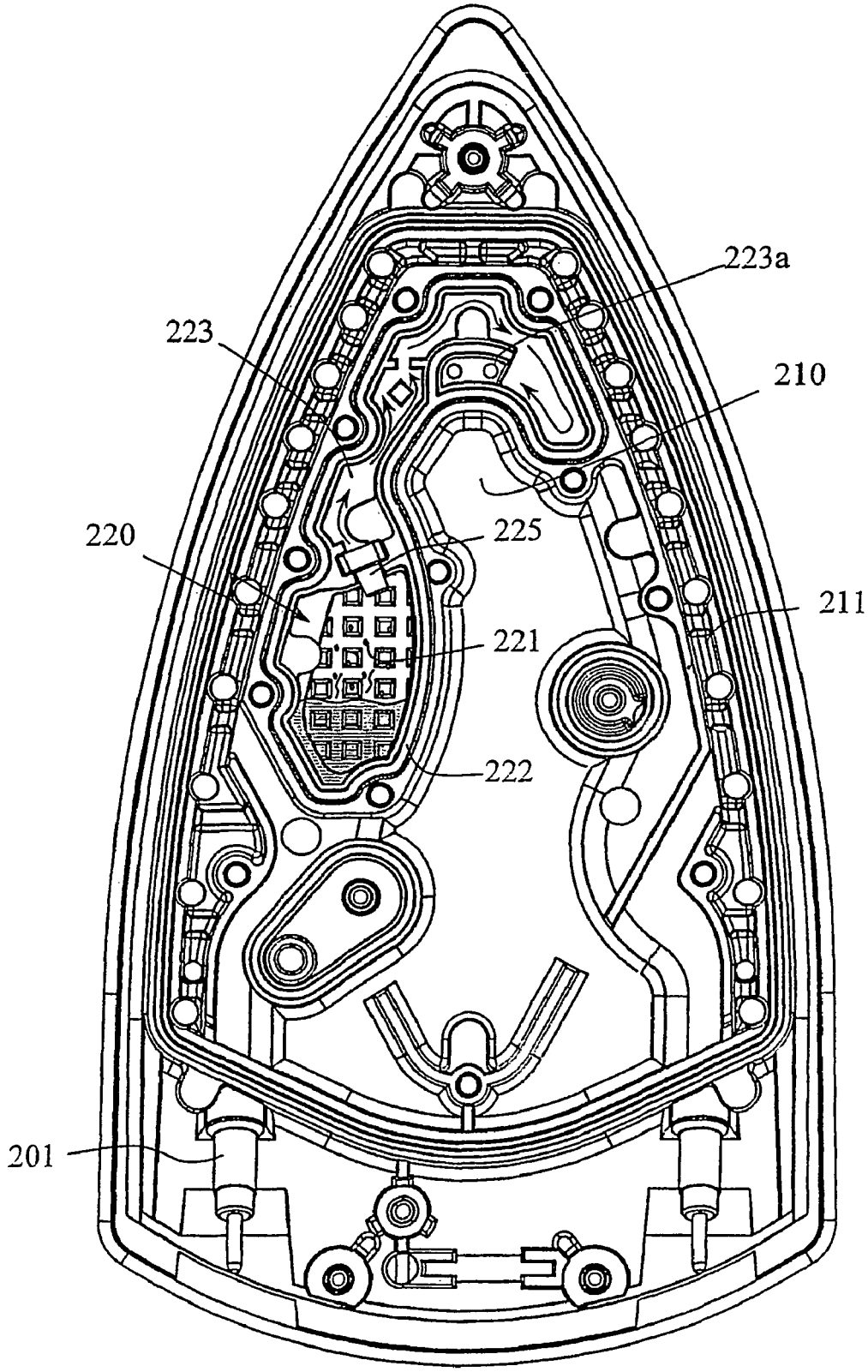
FIG. 3 is a top view of the heating body of FIG. 2 illustrating the injection of water into the second steam chamber when the iron is held vertically.

In accordance with FIGS. 2 and 3, lower wall 221 of steam chamber 220 has raised studs 221*a* of square cross section increasing the heat exchange surface of lower wall 221. In a preferential manner, the volume of steam chamber 220 is greater than 2 ml and advantageously about 5 ml.

Steam chamber 220 is connected to a steam circuit 223 by the intermediary of a single opening 224 formed at the level of the side wall 222 nearest to the front tip of sole plate 1. This opening 224 is formed on a tube or nozzle element 225 that is added on side wall 222 and that is preferentially made out of plastic material or rubber.

Nozzle 225 has a cylindrical tube 225*a* projecting toward the interior of steam chamber 220 and a square base plate 225*b* fitting in a support groove of side wall 222. The passage cross section of nozzle 225 is determined by the internal diameter of cylindrical tube 225*a* that preferentially lies between 1.6 and 2 mm.

The steam circuit 223 is constituted by baffled channels extending toward the front of sole plate 1 while skirting the curve of resistive element 201 in the form of a horseshoe. Steam circuit 223 presents an end provided with two holes 223*a* vertically traversing body 2 and opening on a zone of the front end of sole plate 1 provided with steam outlet holes 104.

An opening 302 is provided in plate 3 and an opening 401 is provided in plate 4, these openings allowing the introduction of a water inlet tube into steam chamber 220. Preferably, water arrives under pressure due to the action of the user on a pump. This pump is preferentially a piston pump that is dimensioned so as to inject 1 ml water into second steam chamber 220 with each action on the pump.

The operation of the pressing iron will now be described with reference to FIG. 3 which represents the sole plate when the iron is held in a vertical position.

When the user wishes a continuous steam jet, for example to smooth a curtain, he presses on the button actuating the piston pump associated with second steam chamber 220. A volume of water of the order of 1 ml, represented with shading in FIG. 3, then arrives abruptly in chamber 220 and is brought to boiling, the conversion of the volume of water into steam being carried out over a period of the order of one second. This steam produced by second chamber 220 escapes in the direction of steam circuit 223 while passing through nozzle 225 which forms a bottleneck slowing down the escape of the steam, thus making it possible to obtain, at the outlet of nozzle 225, a continuous steam flow over a period of the order of 4 seconds.

Nozzle 225, and more particularly the cylindrical tube 225*a* projecting towards the interior of second chamber 220, also allows preventing, by a dynamic effect, water droplets that are too large from passing into steam circuit 223.

Once past nozzle 225, the steam then makes its way through baffled channels of steam circuit 223 while following a course represented by the arrows in FIG. 3. During this travel, the steam is strongly heated which causes the vaporization of possible small water drops mixed with the steam and an increase in the volume of the steam, thus making it possible to obtain steam exiting at a high speed through holes 104 of the sole plate for a length of time of about 4 seconds.

When the user wishes to obtain a substantially continuous steam jet for a longer duration, he can actuate the pump up to four times in succession over a short time so as to fill the second steam chamber 220 with water. This latter possibility is offered thanks to the large volume of second chamber 220, about 5 ml, compared with the volume of the pump and the low pressure reigning in steam chamber 220 after injection of the first volume of water, because of the moderate temperature in steam chamber 220.

The four successive actuations of the pump make it possible to then obtain continuous steam jets exiting from the sole plate over a period longer than 15 seconds, the significant volume of water injected into steam chamber 220 vaporizing gradually while being brought to boiling.

Of course, the user can still prolong the duration of the steam jet by actuating the piston pump at regular intervals.

The iron according to the invention also has the advantage, when it is used in the horizontal position, of preserving a surplus steam mode close to that previously known for irons comprising a second steam chamber of the instantaneous steaming type.

Indeed, when the iron rests horizontally and a 1 ml volume of water is injected into steam chamber 220 by a pressure on the pump, the injected water spreads over the lower wall 221 to cover the totality of the raised studs 221*a* leading then to a heat exchange surface with the hot lower wall 221 that is much greater than when the iron is held vertically. The vaporization of water in steam chamber 220 is thus carried out much more quickly, which makes it possible to obtain an abrupt steam surge at the outlet of the sole plate in order to smooth difficult parts of the fabric being ironed.

Figure 4:
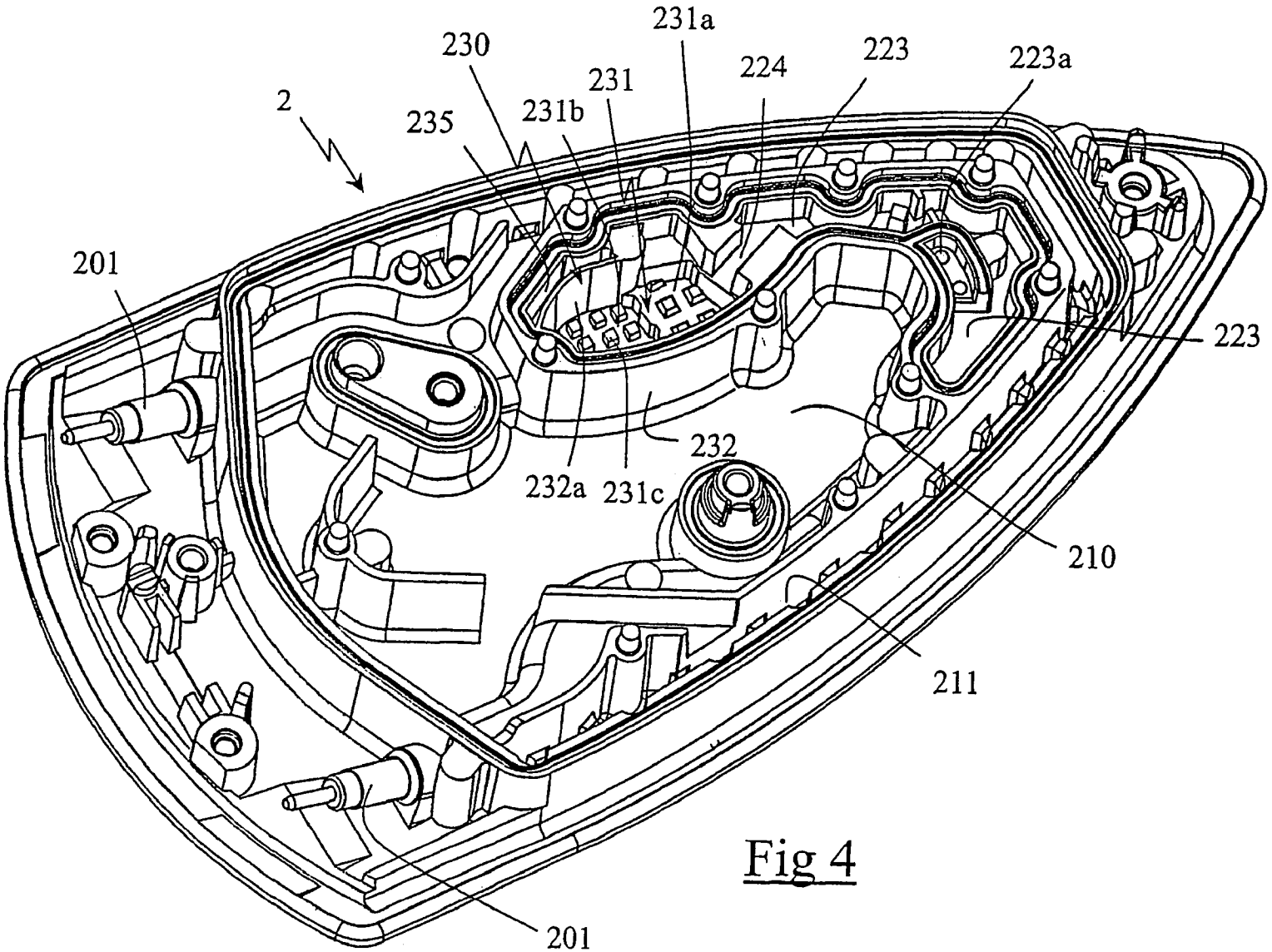
FIG. 4 is a view similar to FIG. 2 of a second embodiment of the heating body of the iron sole plate according to the invention.
Figure 5:
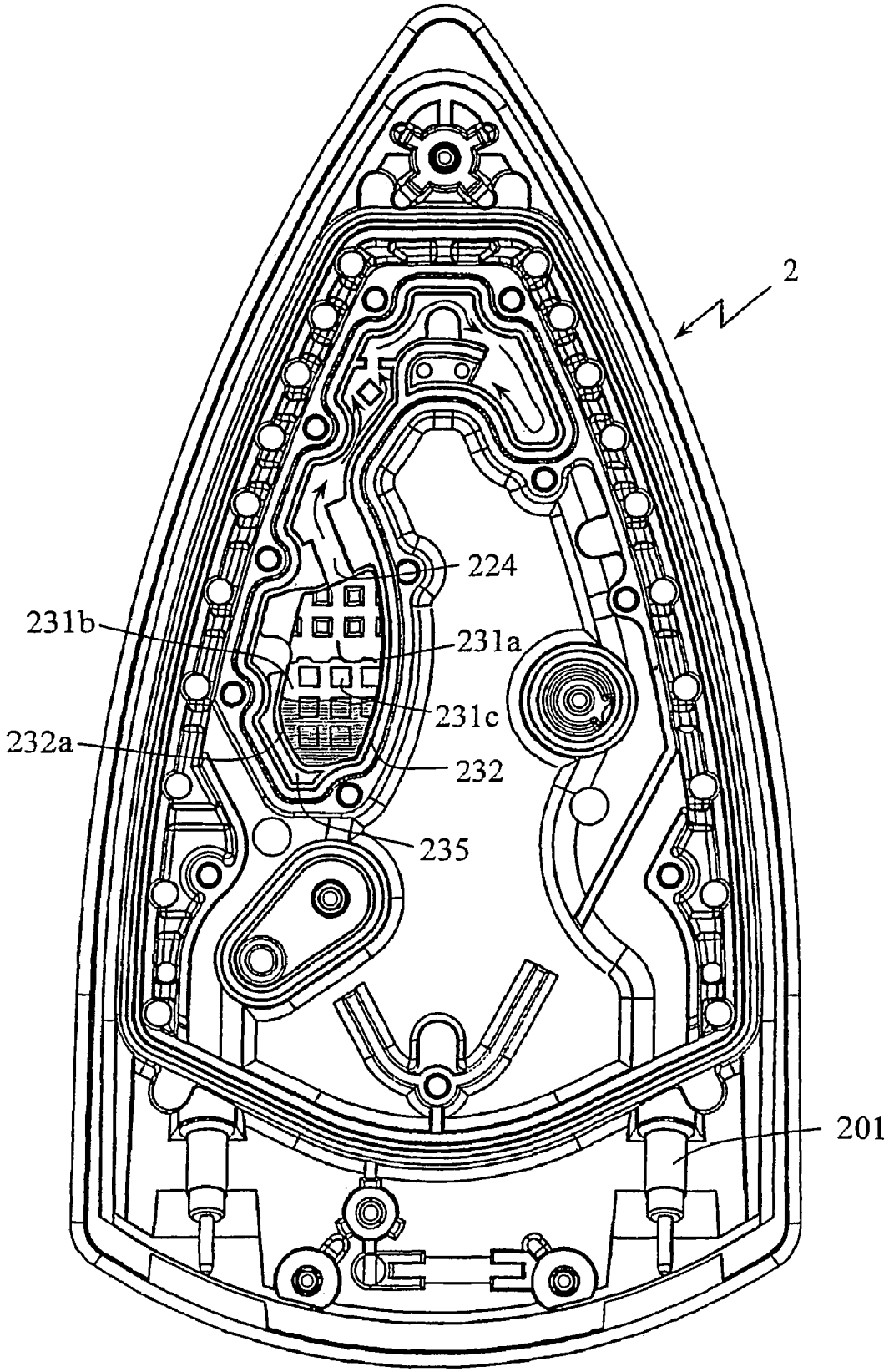
FIG. 5 is a top view of the heating body of FIG. 4 illustrating the injection of water into the second steam chamber when the iron is held vertically.

FIGS. 4 and 5 represent a heating body 2 according to a second embodiment of the invention in which nozzle 225 previously described has been removed and the second steam chamber presents a modified form. The other elements of the iron remain as for them unchanged. This heating body 2, is just like the heating body of FIG. 1, associated with a sole plate 1, and cover plates 3 and 4 not represented in FIGS. 4 and 5.

In accordance with FIG. 4, heating body 2 comprises a second steam chamber 230, of a volume of about 5 ml, extending parallel to one of the branches of resistive element 201 in the form of a horseshoe. Second steam chamber 230 is delimited by plate 4, a lower wall 231 disposed parallel to sole plate 1 and side walls 232. Lower wall 231 has raised studs 231*c* and presents a step cutting steam chamber 230 transversely in two parts 231*a* and 231*b* of appreciably equal size. The front zone 231*a* of lower wall 231 is elevated compared to the rear zone 231*b* of lower wall 231 when the iron rests horizontally so that the thickness of the lower wall 231 is greater at the level of the front zone 231*a* than at the level of the rear zone 231*b*.

The side wall 232 nearest to resistive element 201 has a portion 232*a* of reduced thickness located at the level of the rear zone 231*b* of lower wall 231. This portion 232*a* is separated from the remainder of heating body 2 by a throat 235 which immobilizes a layer of air creating a local heat insulation.

Steam chamber 230 is connected to steam circuit 223 through an opening 224 constituted by a channel crossing the side wall 232 nearest to the front of sole plate 1.

The operation of the pressing iron provided with such a heating body 2 will now be described in relation to FIG. 5 which represents the heating body 2 when the iron is held vertically.

When the user actuates the manual pump to obtain a steam jet, a volume of water of about 1 ml, represented by shading in FIG. 5, flows into the low part of steam chamber 230. Water is then in contact with rear zone 231*b* of lower wall 231, with plate 3 and with side walls 232. The thickness of lower wall 231 at the level of rear zone 231*b* being reduced, the thermal energy stored in this zone of the lower wall 231 is low. Thus, only part of the water present in the chamber is converted to steam instantaneously when the water enters into contact with rear zone 231*b* of the hot lower wall 231, the energy necessary for the vaporization of the remainder of the liquid then being brought gradually by conduction of the energy diffused by resistive element 201 through heating body 2. Moreover, the water contained in the low part of steam chamber 230 is in contact with the portion 232*a* of the side wall 232 that is a relatively cold wall because of its thermal insulation compared to the remainder of heating body 2. There results a progressive vaporization of the water which is brought to boiling in steam chamber 230, thus making it possible to obtain a vaporization of the volume of water injected by the pump over a period of about 4 seconds. The steam is then overheated in steam circuit 223 and a jet of steam at high speed and obtained at the outlet of holes 104 of sole plate 1, over a period of several seconds.

Of course, just like in the first embodiment, steam chamber 230 according to the second embodiment also can be filled with water by successively actuating the pump over a reduced time, which makes it possible to obtain continuous steam jets at the outlet of the sole plate over a period longer than 15 seconds.

The iron according to this second embodiment also has the advantage, when it is used in a horizontal position, of preserving an overheated steam mode in which the steam is produced abruptly. Indeed, in the horizontal position, the water injected into second steam chamber 230 is spread on the entirety of the front 231*a* and rear 231*b* zones of the hot lower wall 231, by covering raised studs 231*c* so that the heat exchange surface with lower wall 231 is much larger than when the iron is held vertically. Moreover, the hot lower wall 231 has a significant thickness at the level of front zone 231*a* which constitutes a reserve of energy that is transmitted quickly to the water present in second steam chamber 230. There results therefrom a vaporization of water in second chamber 230 being carried out much more quickly when the iron is horizontal, which makes it possible to preserve an abrupt steam surge at the outlet of the sole plate for smoothing difficult parts when the iron rests on its sole plate.

Of course, the invention is by no means limited to the embodiment described and illustrated which was only given as an example. Modifications remain possible, in particular from the point of view of the constitution of the various elements or by substitution of technical equivalents, without leaving for all that the field of protection of the invention.

The invention claimed is:

1. Pressing iron having a sole plate (1) provided with steam outlet holes, and a heating body (2) provided with a heating element (201), the heating body (2) comprising a first steam chamber (210) used for ordinary ironing and a second steam chamber (220; 230) used to obtain a surplus of steam when the iron is in the horizontal position or a jet of steam when the iron is in the vertical position, said second steam chamber (220; 230) being fed with liquid by means of a manual pump actuated by the user and being associated with a steam circuit (223) ending in a set of steam openings in the sole plate, characterized in that, said second steam chamber is bounded by walls that prevent any liquid from flowing from said second steam chamber to said steam outlet holes when said iron is in the vertical position, and in that, when the iron is held vertically, the second steam chamber (220; 230) functions as a steam generator of the boiler type and in that, in this vertical position of the iron, the second steam chamber (220; 230) presents a form adapted to retain the liquid injected by the pump before its conversion into steam, the form of the second steam chamber (220; 230) being such that the heat exchange surface between the injected liquid and the walls (3, 221, 222; 3, 231) of said second steam chamber (220; 230) is smaller when the iron is in the vertical position than when the iron is in the horizontal position.

2. Pressing iron according to claim 1, characterized in that the second steam chamber (230) is delimited by at least one wall (231) whose form and thickness are such that, in operation, the thermal energy stored in the wall (231) is greater toward the front of the sole plate (1) than toward the rear of the sole plate (1).

3. Pressing iron according to claim 2, characterized in that the thickness of the lower wall (231) of the second steam chamber (230) is greater toward the front of sole plate than toward the rear of the sole plate.

4. Pressing iron according to claim 1, characterized in that the second steam chamber (230) has a side wall (232) near to the heating element (201) that is at least locally isolated from the heating body (2) by a layer of air.

5. Pressing iron according to claim 1, characterized in that the second steam chamber (220; 230) is delimited by side walls (222; 232) connected to lower (221; 231) and upper (3) walls disposed parallel to the sole plate (1), and in that the side wall(222; 232) nearest to the front of the iron has an opening (224) connecting the second steam chamber (220; 230) to the steam circuit (223).

6. Pressing iron according to claim 5, characterized in that said opening (224) has a passage cross section calibrated to retard the steam flow leaving the second steam chamber (220).

7. Pressing iron according to claim 6, characterized in that said opening (224) has an added element (225) of plastic material or rubber that determines said passage cross section.

8. Pressing iron according to claim 7, characterized in that said added element (225) has a cylindrical part (225*a*) extending toward the interior of the steam chamber (220).

9. Pressing iron according to claim 1, characterized in that the temperature of the walls of the second steam chamber (220; 230) is lower than 150° C.

10. Pressing iron according to claim 1, characterized in that the volume of the second steam chamber 220; 230) corresponds to several times the volume of liquid injected by the pump with each actuation by the user.

11. Pressing iron according to claim 1, characterized in that the second steam chamber (220; 230) has a lower wall, disposed parallel to the sole plate (1), having projecting elements (221*a*; 231*c*) increasing the heat exchange surface with the liquid injected into said chamber when the iron rests horizontally on its sole plate.

12. Pressing iron according to claim 1, characterized in that the volume of the second steam chamber (220; 230) is about 5 ml and the volume of liquid injected by the pump at each actuation is about 1 ml.

13. Pressing iron according to claim 1, further comprising a nozzle in one of said walls bounding said second steam chamber for conducting steam from said second steam chamber to said steam circuit.

* * * * *